US006021884A

United States Patent [19]

Tsuchida

[11] Patent Number: 6,021,884

[45] Date of Patent: Feb. 8, 2000

[54] COIN SELECTING APPARATUS

[75] Inventor: Tamotsu Tsuchida, Iwatsuki, Japan

[73] Assignee: Asahi Seiko Co., Ltd., Tokyo, Japan

[21] Appl. No.: 08/910,766

[22] Filed: Aug. 13, 1997

[30] Foreign Application Priority Data

Dec. 12, 1996 [JP] Japan ..... 8-359352
Dec. 12, 1996 [JP] Japan ..... 8-359353

[51] Int. Cl.[7] ..... G07D 5/02; G07D 3/00

[52] U.S. Cl. ..... 194/335; 194/338; 453/11

[58] Field of Search ..... 194/334, 335, 194/338; 453/7, 11

[56] References Cited

U.S. PATENT DOCUMENTS

| | | | |
|---|---|---|---|
| 521,641 | 6/1894 | Coffin | 194/334 |
| 627,683 | 6/1899 | Cook | 194/334 |
| 1,922,925 | 12/1933 | Bolen | 194/335 |
| 4,332,315 | 6/1982 | Ward . | |
| 4,376,480 | 3/1983 | Abe | 194/323 |
| 4,410,077 | 10/1983 | Okolischan . | |
| 4,884,672 | 12/1989 | Parker . | |
| 5,320,207 | 6/1994 | Abe . | |

FOREIGN PATENT DOCUMENTS

| | | |
|---|---|---|
| 63-29308 | 6/1988 | Japan . |
| 1 374 857 | 11/1974 | United Kingdom . |

*Primary Examiner*—F. J. Bartuska
*Assistant Examiner*—Bryan J. Jaketic
*Attorney, Agent, or Firm*—McGlew and Tuttle, P.C.

[57] ABSTRACT

A coin selecting apparatus which can change for coin sizes simply. The coin selecting apparatus includes a plate which has a vertical length opening for throwing a coin thereinto, a diameter gage slidably disposed on this plate and having a guide portion to partially seal the length of the opening, and a thickness gage slidably disposed on said plate to partially seal the width of the opening. The coin selecting apparatus has a front part, which is made of a plastic formed product having a rectangular plate form, base part which made of a plastic formed product having an approximately rectangular plate form, a chute cover part made of a plastic formed product having an approximately tail-fin-shaped form and a door part made of a plastic formed product having a slightly small rectangular plate form.

17 Claims, 13 Drawing Sheets

COIN SELECTING APPARATUS

FIELD OF THE INVENTION

This invention relates generally to a coin selecting apparatus to select a coin or a small disk body (coinage domestic and foreign, medals and tokens for game and the like), and more particularly to a coin selecting apparatus which selects only a desired or specified coin mechanically and cancels or rejects other coins, especially an apparatus incorporated into a vending machine, a game machine, or a money changing machine or the like.

BACKGROUND OF THE INVENTION

Past mechanical coin selecting apparatuses include various types. For example, there is a selecting apparatus which is elucidated on the bulletin of Japanese Patent Publication 63-29308 (or Japanese Patent Application 54-B-0356 which is a priority document of U.S. Pat. No. 4,376,480) of the present assignee.

This coin selecting apparatus is shown in FIG. 10, FIG. 11, FIG. 12, and FIG. 13. This apparatus is provided with a coin throw in mouth or deposit opening 2 and a reject mouth 4 at the top and bottom of a rectangular metal front plate 1. A cancel lever 3 is provided at the middle position between these. On the reverse side of this front plate 1, as shown in FIG. 11, the front-edge of a base plate 6, which is a die casted as an approximately rectangular element, metal is fixed.

On the upper edge of this base plate 6, the upper edge of a door plate 7, which is a die casted small rectangle metal, is pinched and connected by a hinge 14 which has elasticity. Inside these, a diagonal passage 25, for the coin selecting is formed as shown in FIG. 13. The trailing and lower edges of door plate 7 are surrounded by a chute cover plate 8 which is a die casted laterally T-shaped metal part as shown in FIG. 12.

The front-end of this chute cover plate 8 is fixed on the front plate 1 by means of screws 18 and nuts 19. Then, the trailing edge thereof is connected by holes 15 in the ring parts and the projections 16 of base plate 6. The side wall portion 9 in FIG. 12 functions as a chute plate for guiding an accepted coin. The diagonal passage 25 for selecting the coin communicates with the deposit opening 2 at the entrance side of the upper right as shown in FIG. 13. The passage 25 communicates with the reject mouth 4 through the cancel chute or rejection chute 27 at the lower portion thereof. Also, the passage 25 communicates with an accommodating chute 26 to take in a desired authentic coin at the outlet side of the lower left thereof.

Upwardly in the diagonal passage 25, an approximately V-shaped cradle 40 is pivoted at 41 intervening between parts of the door plate, as shown in FIG. 12. The cradle 40 has two engagement strips 42 and 43 which are spaced away a slightly small distance than the diameter of selected authentic coin.

The engagement strips 42 and 43 pierce through arc holes 44 and 45 of the door plate 7 freely and project into the passage 25 inside. A small column form 46 in the drawing is a weight for the balance.

Symbol 35 near the cradle 40 in FIG. 13 is a stick-shaped magnet and is installed on the door plate 7 as shown in FIG. 12. The magnet 35 is the member to absorb and to remove a scrap of iron, a suspected iron coin and so on. Symbol 57 at the center of FIG. 13 is an inclined rail to rotate a coin, and is formed on the passage 25 side of base plate 6. On the lower portion of the inclined rail 57, the slit 66 for checking the coin thickness is formed (see FIG. 13).

The width of slit 66 is altered by the free adjustment of the screw 67, free in screwing in and out of the pierced through door plate 7 which is shown at the center of FIG. 12. At the center of the passage 25 in FIG. 13, a magnet 50 for checking material is disposed. The magnet 50 is arranged by the base plate b and holding plate 53 as shown in FIG. 11.

The operation of this device is summarized and explained based on FIG. 13.

FIG. 13 shows the checking course of a desired authentic coin A which falls to the accommodating chute 26 for the acceptance at the lower left thereof. Also, FIG. 13 shows the checking course of a suspected coin B which is returned to the reject mouth 4, falling to the rejection chute 27 at the lower right thereof.

First, the coin diameter and thickness are checked at the deposit opening 2.

When either of these is too large, the coin is not inserted in the throw into mouth or deposit opening 2 and is excluded as a suspected coin B1.

The coin A1 which passed the mouth 2 is guided to the cradle 40 by the guide fragment or portion 99 which was formed on the side of passage 25 at the upper portion of base plate 6. A guided coin is held between one pair of engagement strips 42 and 43 like a coin A2. At this time, a small diameter resemblance coin B passes the cradle 40 and falls to the rejection chute 27, as shown at an arrow B2.

Symbol 89 in the drawing is a slope surface for suspected coins B which is formed on the side of passage 25 at the lower portion of base plate 6. In the same way, symbol 88 is a prevention wall which also is a bottom of the slope surface 89. These prevent invasive actions such as wire insertion, a coin throwing, and so on, from the reject mouth 4.

Symbol 10 at the lower portion of FIG. 12 is the cover part for the slope surface 89 and rejection chute 27. This cover part 10 is formed on the central end part of laterally T-shaped chute cover plate 8.

The suspected iron coin B which adhered to the magnet 35 falls with the open and close of door plate 7 by the operation of cancel lever 3.

The suspected coin B to have fallen is, as shown at the arrow B2 in FIG. 13, returned to the rejection chute 27. The coin which was rotated to the direction of arrow A3 by the cradle 40 rolls out from the cradle 40 and passes through the inclined rail 57, as shown at the arrow A4.

The coin then receives a thickness checking by the slit 66. A thin suspected coin B is rejected—sent to the rejection chute 27 as shown at the arrow B3.

Also, the coin is under powerful magnetic force by the magnet 50 when moving, rotatably on the inclined rail 57. The suspected coin B which was influenced by the magnetism can not ride over the nail 79 for checking notches and the coin separating portion 74 due to its speed being braked by the magnetic fields effect. Therefore, it is returned to the rejection chute 27 as shown at the arrow B4.

Further, the nail 79 for checking notches and the coin separating portion 74 are formed by the bottom tip of pendulum lever 71. These swing-freely and extend through the arc hole 75 and protruded into the passage 25. Also, the upper end of the pendulum lever 71 is pivoted at 72 on the base plate 6 and the weight 73 is fixed on the bottom tip thereof. Moreover, the screw 76 is freely screwed and extends through at the base end of separating portion 74.

This screw 76 is a member for adjusting the position of separating portion 74 by the movement thereof.

Thus, the desired authentic coin A, which is not influenced by the magnetism, rides over the nail 79 for the notches checking and the coin separating portion 74 without the speed being braked. That is, it moves rotatably from the arrow AS to the arrow A6, the coin A passes through the accommodating chute 26 for accepting the authentic coin. Then, the coin A is stored in the safety box which is omitted in the illustration. The operation arm 82 of detection switch 80 which is shown in FIG. 11 is operated.

Also, symbol 90 at the lower portion in FIG. 13 is the perpendicular wall which forms the rejection chute 27 and the wall 90. This is molded to the prevention wall 88 of base plate 6. For example, when the coin hits into the reject mouth 4, the wall 90 is prevents it from going into the accommodating chute 26, passing the rejection chute 27.

The side plates 6, 7 and 8 are provided at the upper edge portions thereof with grooves 20, 21 and 22 formed on the outside surfaces for engaging the edges of a slit in the hinge 14. The blocker 30 includes a movable armature 32. The blocker arm 33 is usually urged into a blocking position by means of a spring so as to extend the free end thereof into the coin sorting passage 25 through a hole 34 in the stationary side plate 6. A keeper 55 opposing the magnet 50 is positioned within an opening 54 formed in the movable side plate 7 and fixed thereto by means of screws 56.

A coin deflector 70 is deposed in the coin package for effecting the separation of acceptable coins from non-acceptable coins. The pendulum lever 71 is provided with a thin leaf spring 78. An outlet 81 is at the lower end of the coin accommodating chute 26. A weight 87 is provided which acts with blocking lever 83. An oblique sliding surface 89 is provided at the upper side of the stopping wall.

Further, the slant elongated member which is at the left portion in FIG. 11 is an arm 33 of blocker 30. In case of use prohibition or the trouble on the vending machine and the game machine and so on, this member prevents the coin's being inserted from the deposit opening 2. During normal use, the electromagnet 31 is turned on and the tip of arm 33 is withdrawn from the passage 25. Therefore, the coin being deposited in the deposit opening 2 is possible.

The axis 91 of cancel lever 3 in FIG. 10 is provided rotatably extending through the front plate 1 as shown in FIG. 11. The lever axis 91 is rotatably held in the bearings 92 and 92 which are formed on the base plate 6. The cam 93 which is an approximately ¼ disk shape is fixed on the axis 91 and moves together with the cancel lever 3. Symbol 95 nearby is the projection with a reversed triangle form. The projection 95 is connected to the cam 93 which is formed on the lower portion of the door plate 7. The cam 93 has a driving face 94. The projection 95 has a driving face 96.

Therefore, the cam 93 is rotated when the cancel lever 3 is rotated, and intervenes in the projection 95, the door plate 7 is opened, resisting the elasticity of hinge 14. As the result, with the magnet 35 and so on, the coin which was stopped within the passage 2 falls.

The slightly slender member 83 at the left in FIG. 12 is a lever for string prevention. The neighborhood of upper end of lever 83 pivoted freely swinging at 84 on the chute cover plate 8 and the bottom tip 85 thereof is within the accommodating chute 26. Generally, the bottom tip 85 of lever 83 is within the coin accommodating chute 26 and is hit outside by the coin which falls. However, a coin which is hung by a thread is prevented from being drawn up. In this way, it is prevented that the detection switch 80 is improperly operated.

SUMMARY AND OBJECTS OF THE INVENTION

It is an object of the invention to provide a lighter coin selecting apparatus by not forming the whole of the apparatus from metal.

For the main portions of a coin selecting apparatus, the weight with die cast components can be heavy compared with the size of the apparatus. The weight becomes the focus of treatment in cases of conveyance of the parts, construction of the apparatus, carriage of the apparatus products and so on. This weight became the focus of lightening of the vending machine, the game machine and so on which the apparatus is incorporated into.

In addition, there is a need to arrange the size of the deposit opening in various ways, corresponding to each kind of various coins. Also, there is the need to account for various problems such that the string-proof lever must be adjusted and so on, corresponding to the size of coin.

A further object of the invention is to provide a coin selecting apparatus which lightens the weight of the apparatus and provides an apparatus which is able to correspond to the coin size simply even if the coin size/shape is changed.

According to the invention, a coin selecting apparatus is provided with a plate which has a vertical length opening for depositing (throwing) a coin thereinto. A diameter gage is slidably disposed on this plate and has a guide portion to seal the length in the opening partially. A thickness gage is slidably disposed on the plate and partially seals the width in the opening.

According to the invention a coin selecting apparatus is provided with a plate which has a vertical length opening to throw or deposit a coin and has a pair of upper and lower oblong holes near this opening. A diameter gage is provided in the form of a rectangular plate, which has a pair of upper and lower vertical long holes and has a guide portion to partially seal the length in the opening. A thickness gage is provided in the form of a rectangular plate which has screw holes, to fasten the screws, which extend through the vertical long holes and oblong holes slidably and for partially sealing the width of the opening.

The present invention also provides a coin selecting apparatus which preferably has at least: front part which consists of a plastic formed product (molded or extruded thermoplastic element) having a rectangular plate form, a base part which consists of a plastic formed product having an approximately rectangular plate form, a chute cover part which consists of a plastic formed product having an approximately tail-fin-shaped form, and a door part which consists of a plastic formed product having a slightly small rectangle plate form.

Further the present invention preferably provides a coin selecting apparatus wherein a metallic plate is equipped on the reverse side of the front part.

The present invention may also provide a coin selecting apparatus wherein the door part is transparent.

The various features of the novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
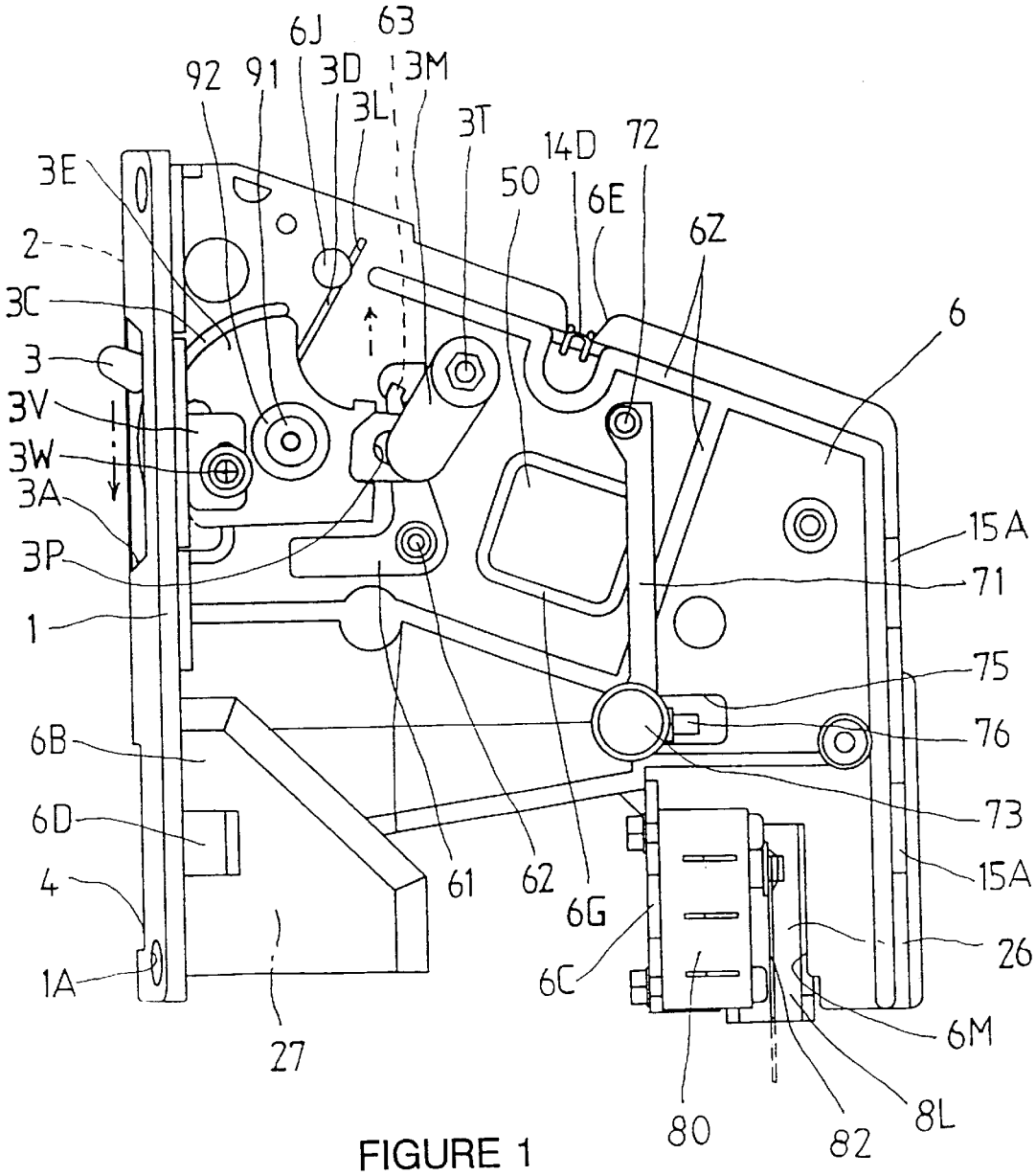
FIG. 1 is a side view of an embodiment according to the invention as seen from the right side thereof (based on a front side being the user interface side)

This invention is explained below, referring to the attached drawings of the embodying according to the invention. In the case of a part which has a similar function, numerals and symbols for referenced elements which are used for the drawings of the embodiment of the invention are the same as the reference numerals and symbols which were used as to the above description of prior art.

Figure 2:
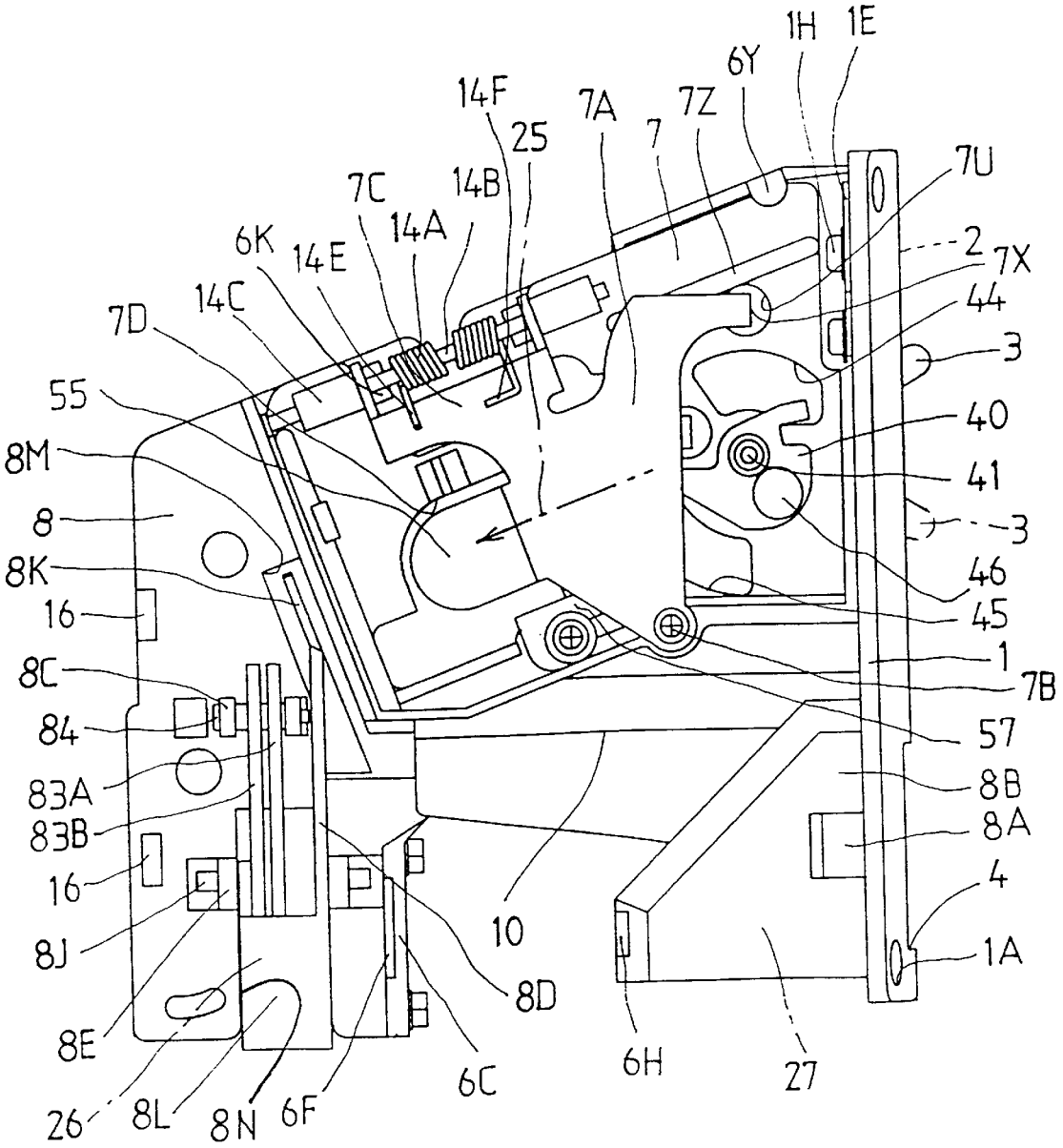
FIG. 2 is a side view of the embodiment of FIG. 1 as seen from the left side.

FIG. 1 is a side view of a preferred embodiment of the invention as seen from the right, considering the front the user interface side. FIG. 2 is a side view which the above embodiment is seen from the left side thereof. FIG. 3 to FIG. 9 are respectively exploded perspective views of the main portions of the above embodiment.

Figure 3:
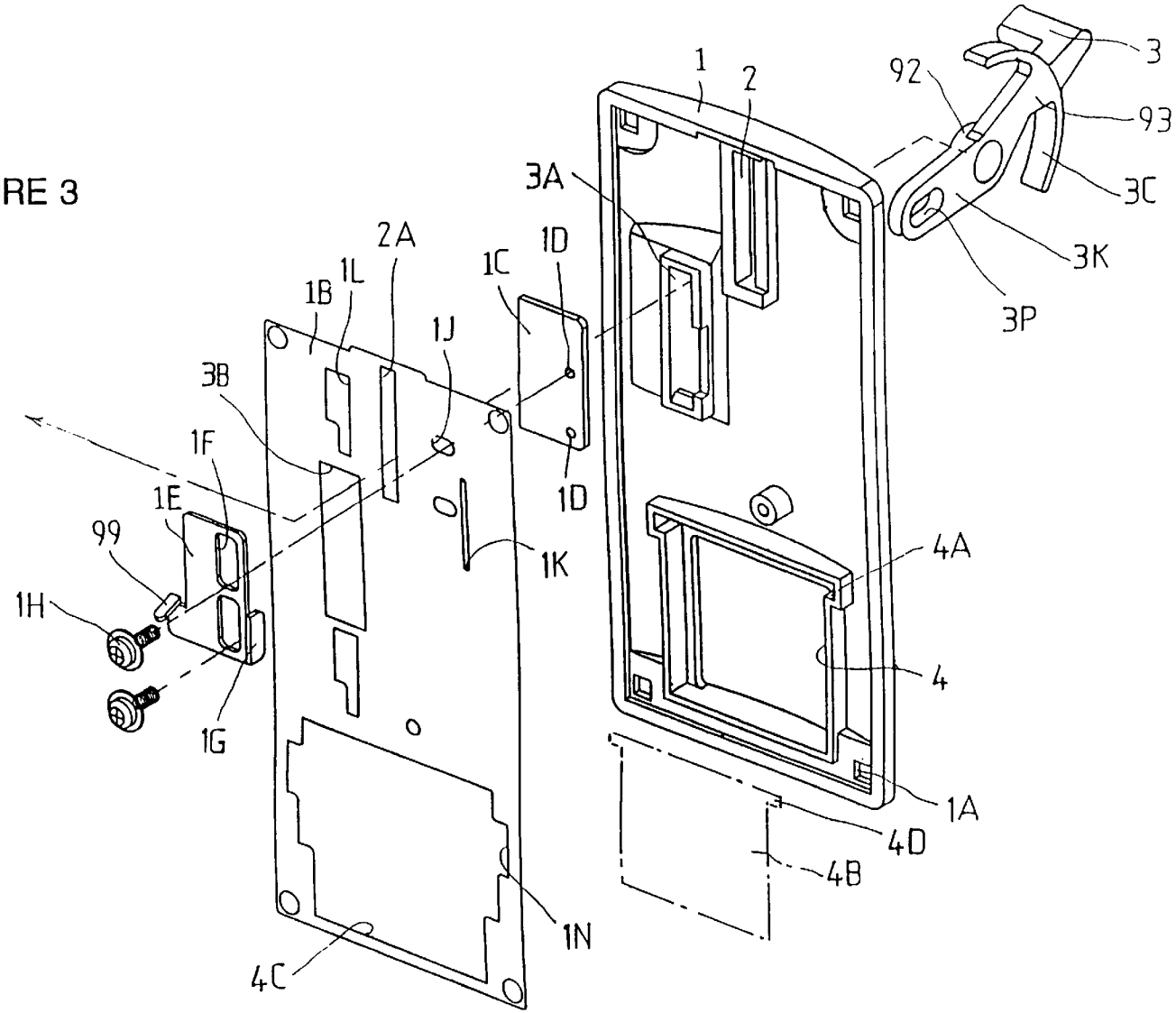
FIG. 3 is an exploded perspective view of the front part of the embodiment of FIG. 1.

As can be seen in FIG. 3 in the exploded perspective view showing the front part. A rectangular plate in the right of FIG. 3 is a front body 1. The front body 1 preferably consists of a plastics formed product. A coin deposit opening 2 is formed at the upper portion of body 1 and a rejection mouth 4 is formed at the lower portion. A vertical long hole 3A is further formed at the middle position of body 1, and a cancel lever 3 with an approximately bow and arrow shape is inserted into the vertical long hole 3A from the base end side thereof. Cancel lever 3 becomes slidable in the upper and lower directions. In addition, in the four corners of front body 1, holes 1A are provided for mounting.

At the upper position of the reverse side of the rejection mouth 4, one pair of depressions 4A are formed. These are provided to pivot the upper edge of both ends of a lid plate 4B. The lid plate 4B is substantially rectangular.

A rectangular plate 1B on the left of FIG. 3 is made of metals such as iron to be fitted freely to the reverse side of front body 1. Openings 2A, 3B, and 4C corresponding to the front body 1 are formed respectively. In addition, one pair of top and bottom keyholes 1L are provided sandwiching the opening 3B to allow for the insertion, freely without disconnection, of one pair of hook portions 6A which are shown on the left of FIG. 5, as described below.

Also, there are cuttings IN of a keyhole shape in both sides of the big opening 4B (of the rejection mouth 4). These cuttings IN are members for the insertion, freely without disconnection, a hook portion 6D which is shown on the left of FIG. 5 and a hook portion 8A which is shown on the right of FIG. 6 respectively, as described below. Reference symbol 1C at the center of FIG. 3 designates a thickness gage in the form of a small rectangular plate to set down the thickness of coin which passes the deposit mouth 2. The thickness gauge 1C has two screw holes ID.

1E at the left of FIG. 3 designates a diameter gage in the form of a small approximately rectangular plate. The diameter gage 1E is a member to set down the diameter of coin which passes the deposit opening 2.

The diameter gage 2E has two vertical long holes 1F and has a slide portion 1G which projects to the face side. A coin guide portion 99 projects to the reverse side.

Two screws 1H go through the vertical long holes 1F of diameter gage 1E freely respectively and go through the oblong holes 1J of plate 1B freely to be screwed into screw holes 1D at the thickness gage 1C, as described below.

The slide portion 1G is slidably inserted into the slit 1K of plate 1B.

Figure 4:
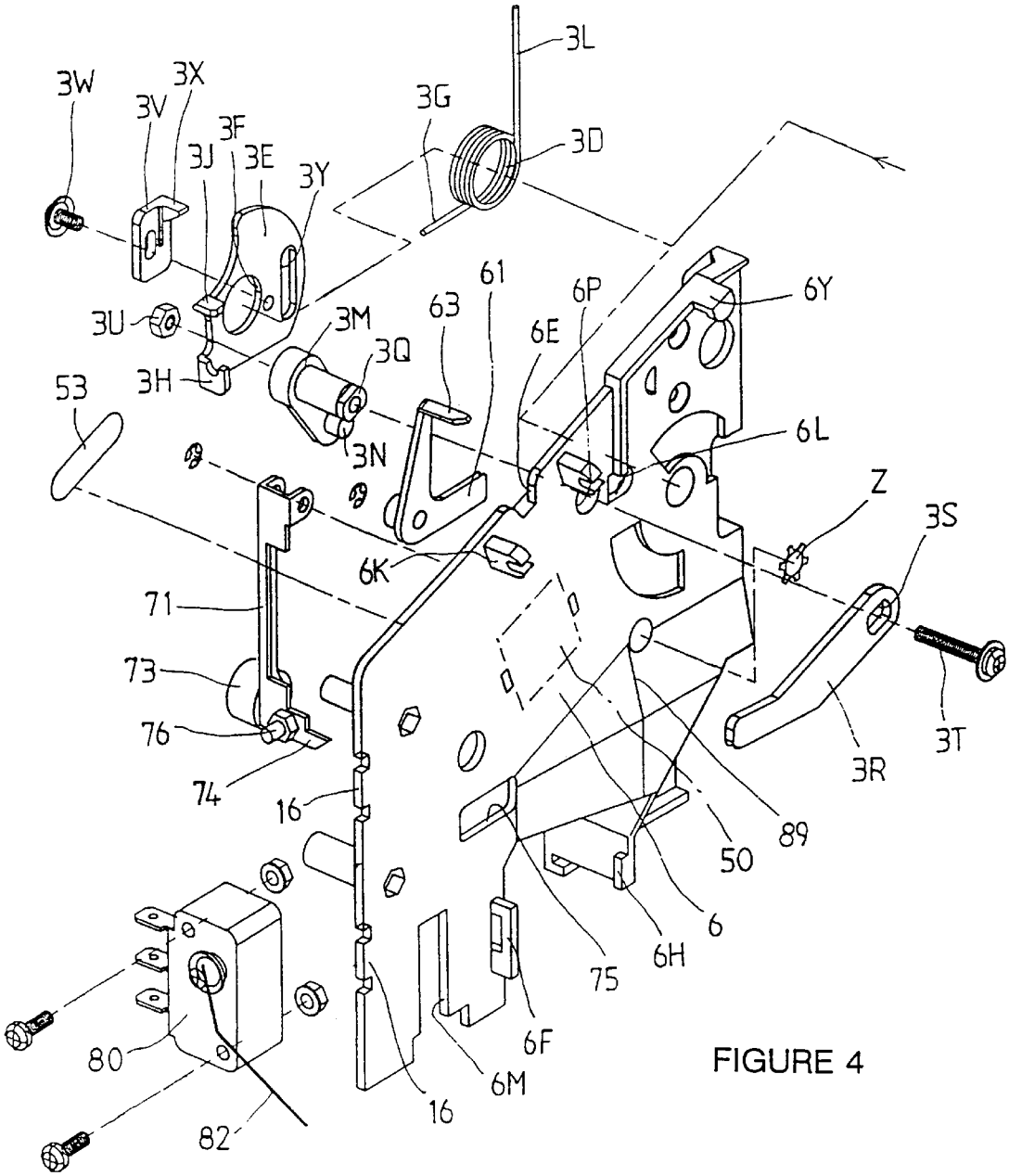
FIG. 4 an exploded perspective view of the base part of the embodiment of FIG. 1.
Figure 5:
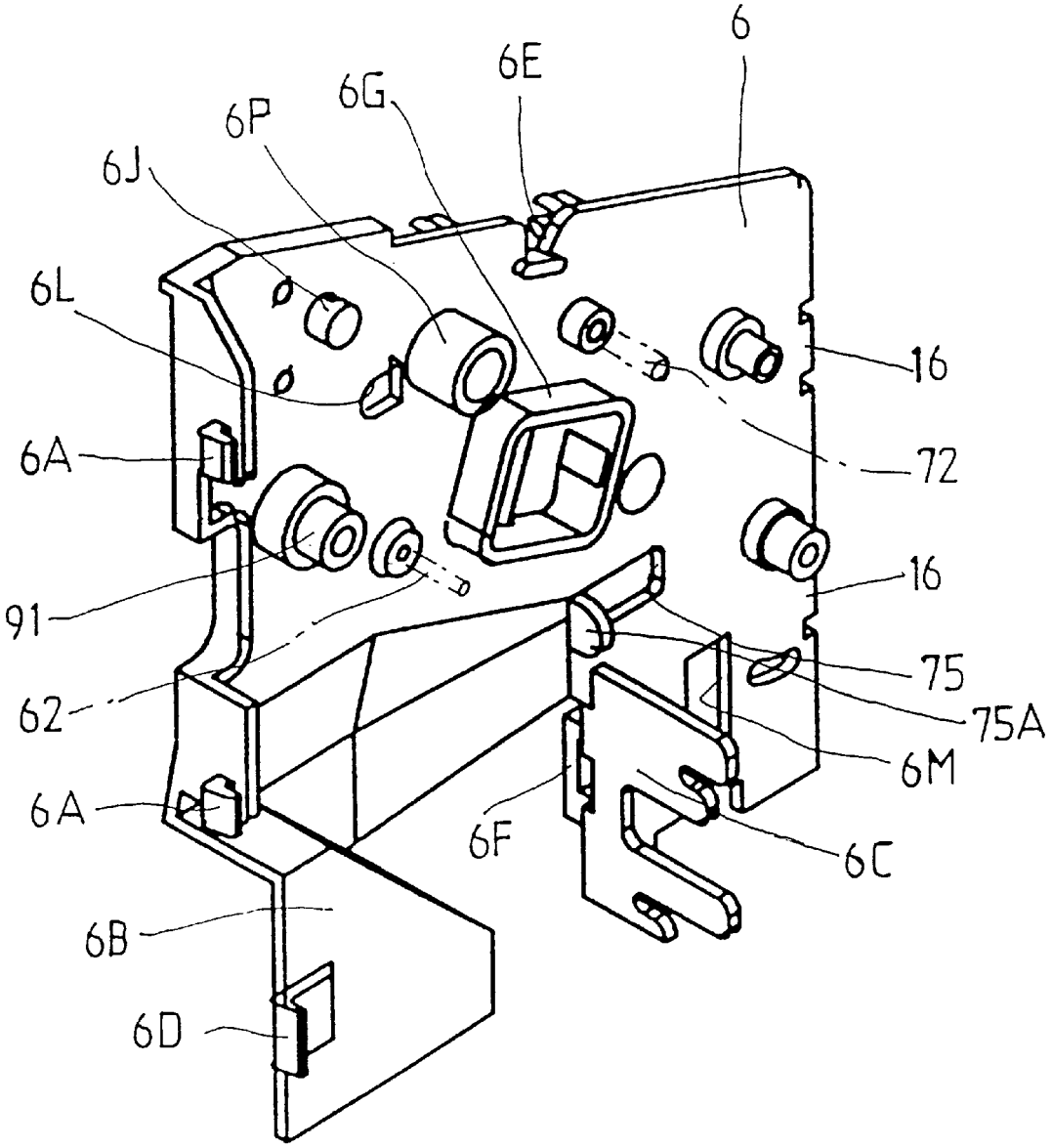
FIG. 5 is a perspective view of the outside of the above base part of the embodiment of FIG. 1.

FIG. 4 shows, by exploded perspective view, the base part of the preferred embodiment. The big rectangular plate is a base body 6 and the base body 6 consists of a plastics formed product. The inside, which is the passage 25 side of base body 6, is shown. In FIG. 5, the outside of base body 6 is shown. On the bent front edge of base body 6, two hook portions 6A (referring to FIG. 5) for attaching and fixing are formed, as above-mentioned.

A half box 6B forms the rejection chute 27. The half box 6B is mainly formed extending outside at the front-edge lower portion of base body 6. At the front-edge of this half box 6B, one hook portion 6D for mounting and fixing is formed, as above-mentioned.

At the approximate center of lower edge of the base body 6, a mounting portion 6C for a detection switch 80 is formed outside to stand up and a ring part 6F is formed inside.

In the center of the upper edge of base body 6, a U letter-shaped cutting 6E is formed as described below and, on the trailing edge thereof, projections 16 form fittings to be combined with small notches.

A rectangular tubular member which is shown at the center of FIG. 5 is a case 6G to hold a magnet 50. Axes 72 and 62 nearby at the top and the bottom of case 6G are made of metal, and these are planted and fixed during the forming of plastic base body 6.

Figure 6:
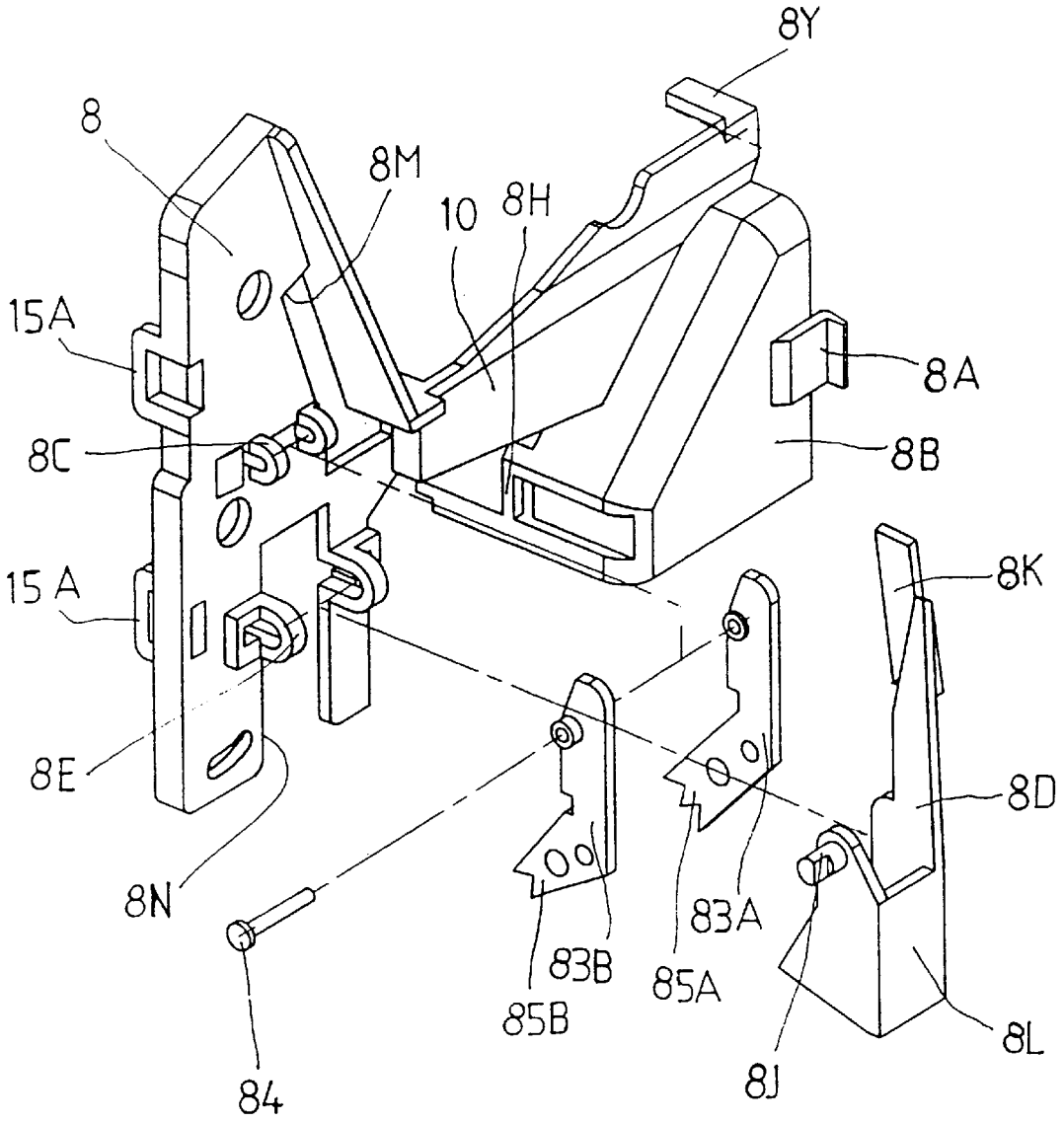
FIG. 6 is an exploded perspective view of the chute cover part of the embodiment of FIG. 1.

The chute cover part of the embodiment is shown in an exploded perspective view in FIG. 6. The big tail-fin-shaped member at FIG. 6 is the chute cover body 8. This chute cover body 8 consists of a plastic formed product.

Figure 7:
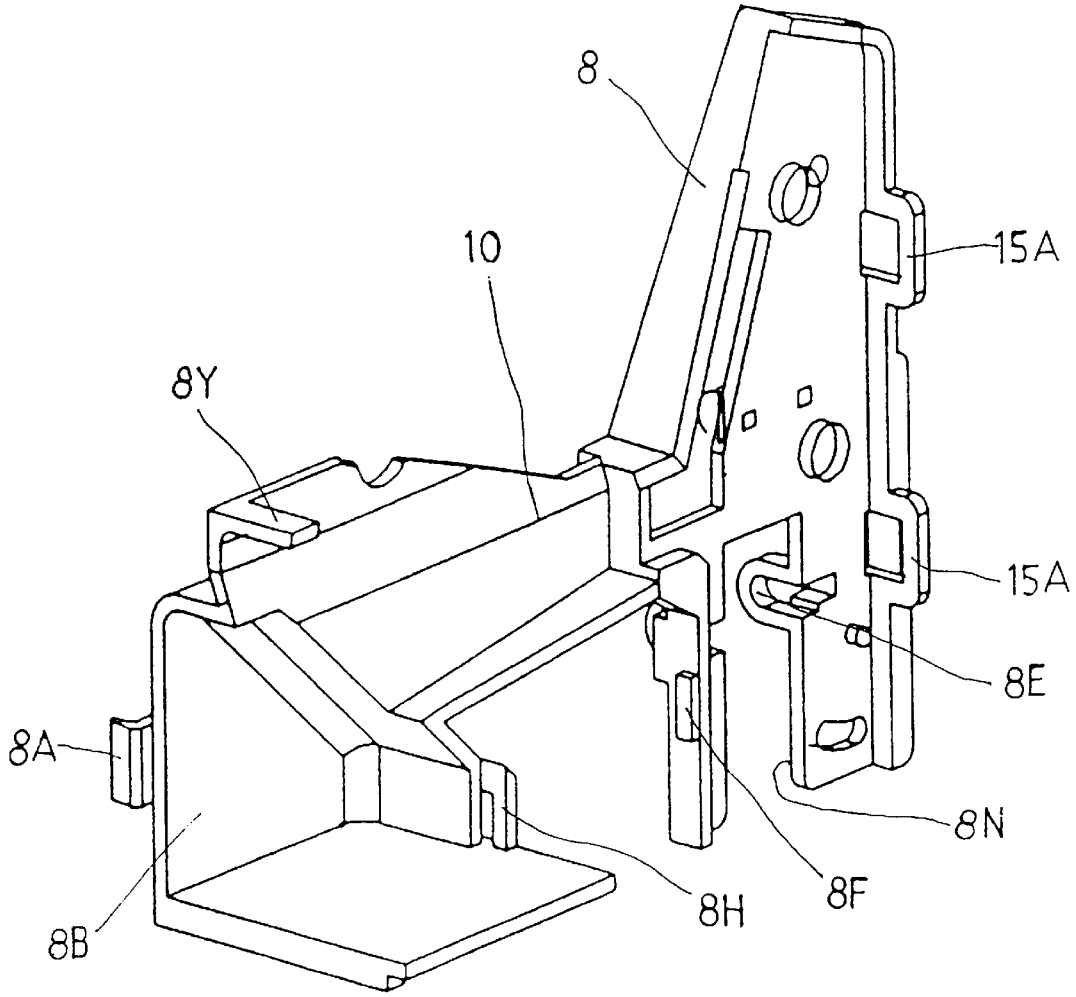
FIG. 7 is a perspective view of the inside of the above chute cover part.

FIG. 6 shows the outside of chute cover body 8 and FIG. 7 shows the side of passage 25 which is the inside of chute cover body 8. The chute cover body 8 is explained below.

At the front-end, a half box 8B for the rejection chute 27 projects mainly outside. On the front-edge of this half box 8B, one hook portion 8A for the attachment is formed. Moreover, on the trailing edge, one pair of ring parts 15A are formed and fitted with the projections 16 of FIG. 4 and FIG. 5.

One pair of bearings 8C are project outside to mount large and small levers 83A and 83B for the thread hanging prevention. In addition, bearings 8E are formed to pivot a rather big J-shaped shutter 8D. As described below, the shutter 8D is a member to protect the detection switch 80 from responding to the throwing of coins.

Figure 8:
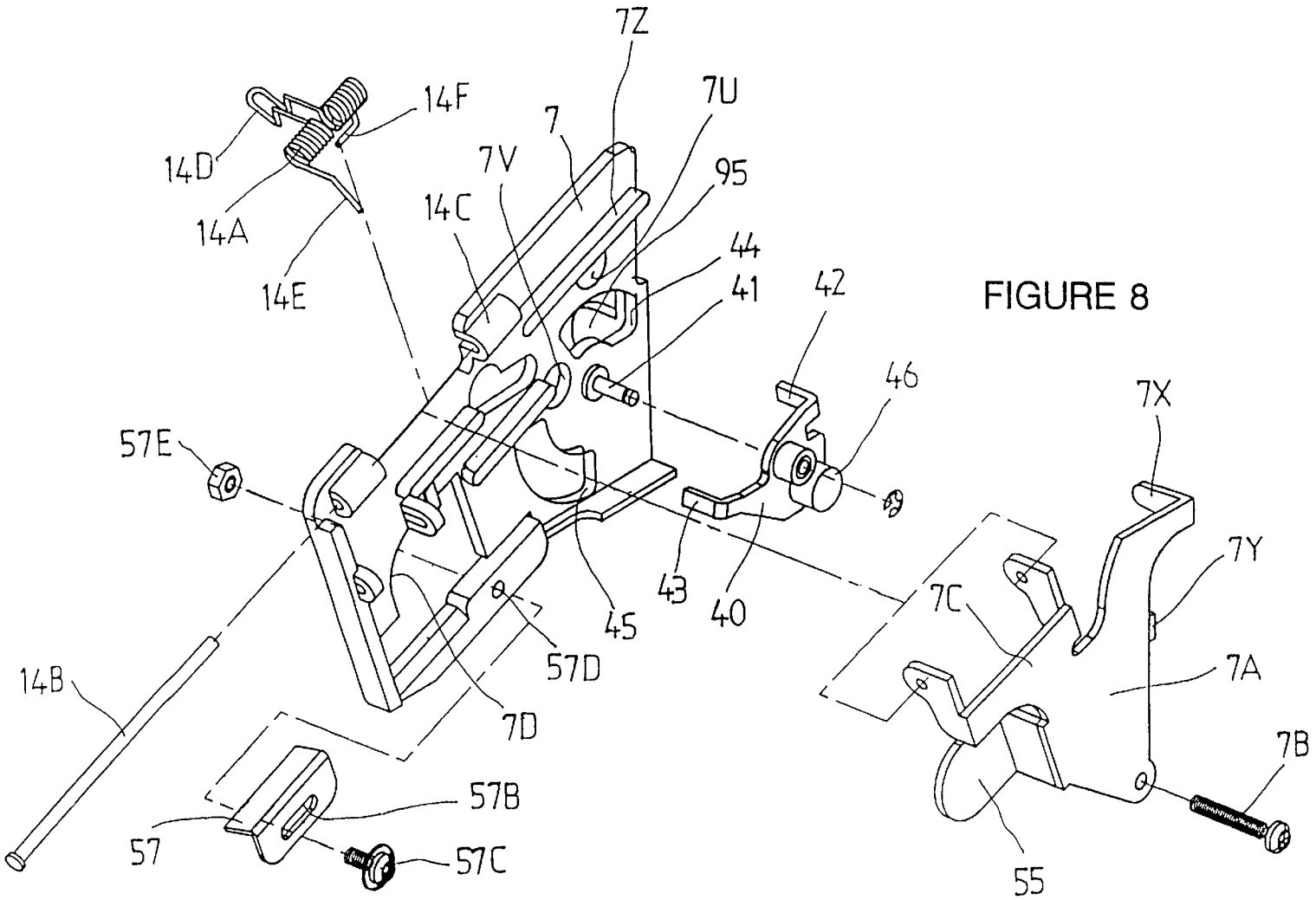
FIG. 8 is an exploded perspective view of the door part of the embodiment of FIG. 1.
Figure 9:
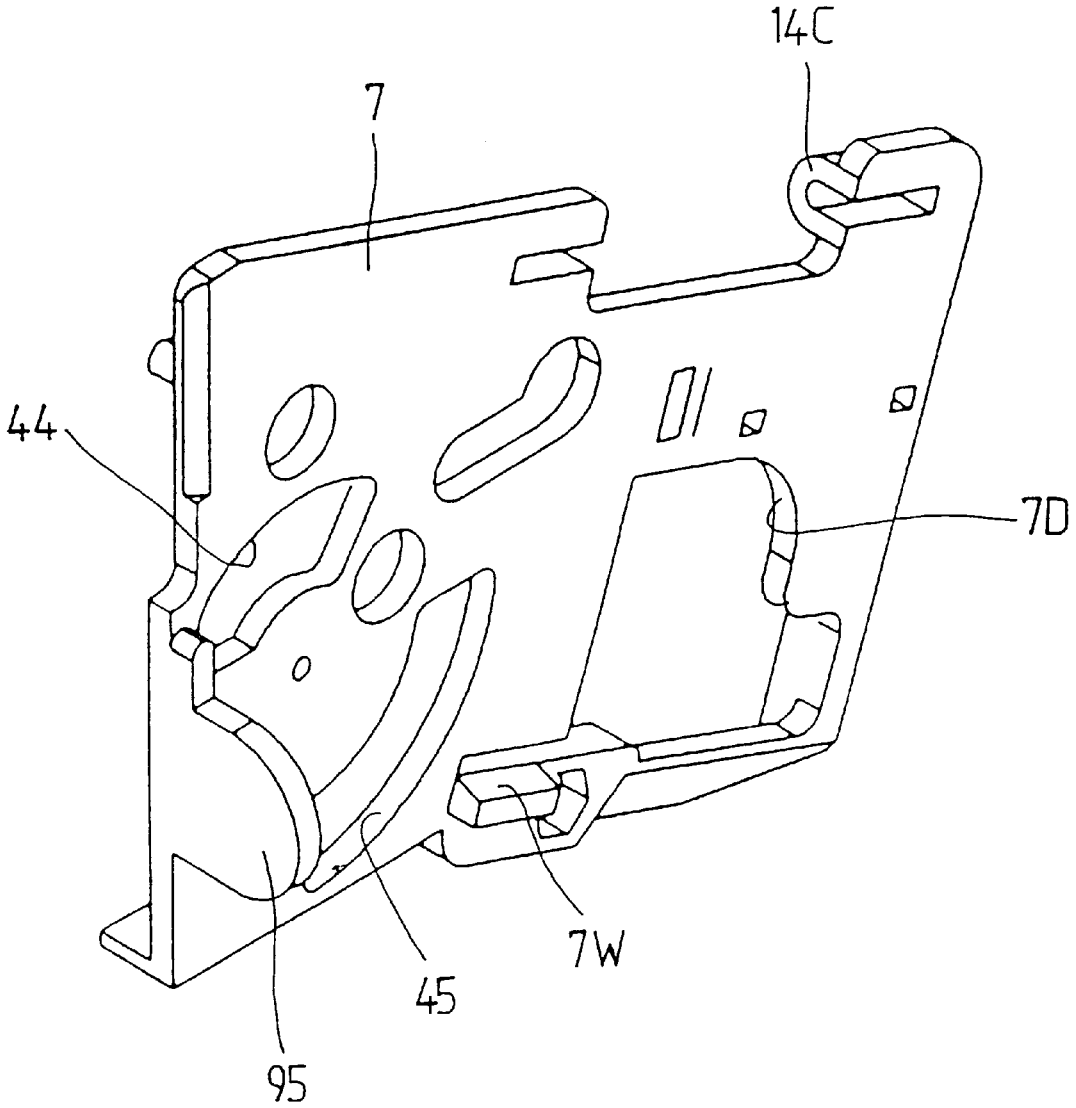
FIG. 9 is a perspective view of the inside of the above door part.
Figure 10:
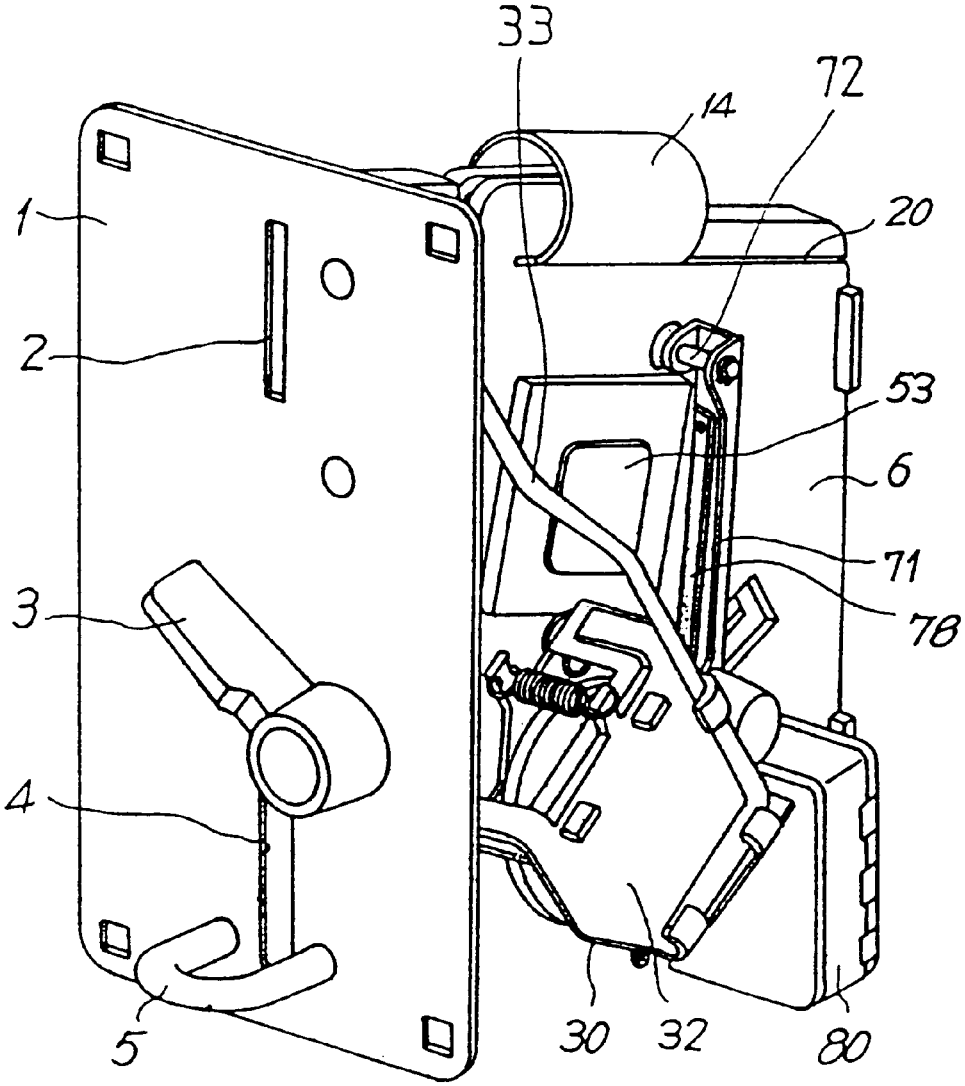
FIGURE 10 (PRIOR ART)
FIG. 10 is a perspective view which a prior art is shown from the front thereof.
Figure 11:
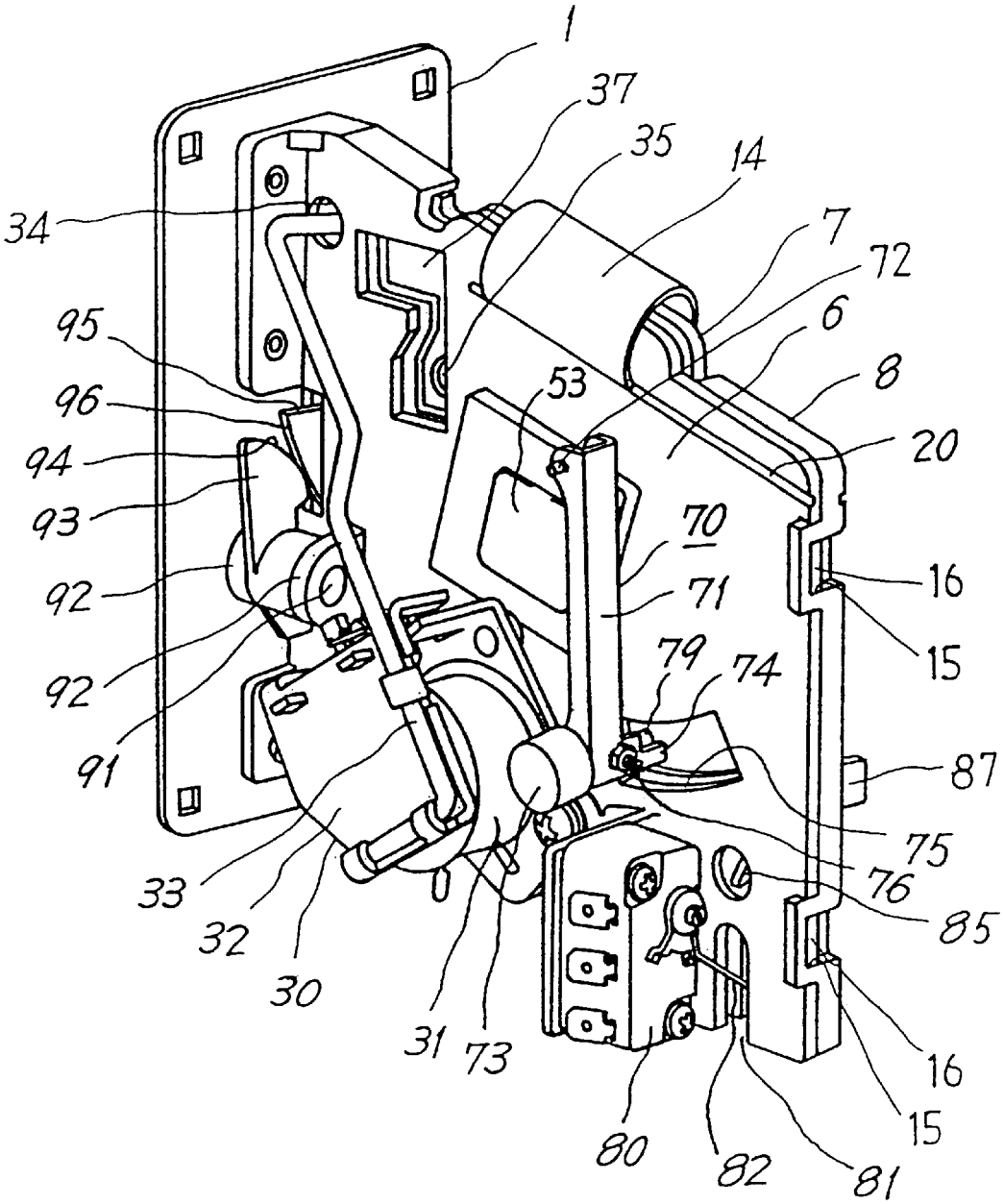
FIGURE 11 (PRIOR ART)
FIG. 11 is a perspective view from the back of a coin selecting apparatus of the prior art.

The door part of the embodiment is shown in FIG. 8 in an exploded perspective view. The small rectangular plate which is shown in FIG. 8 is a door body 7. The door body 7 consists of a transparent plastic formed product. FIG. 8 shows the outside of door body 7 and FIG. 9 shows the inside of door body 7, i.e. the side of coin passage 25.

FIG. 8 is explained below. The axis 41 for a metallic cradle 40 is fixed at the center of the front-edge side of door body 7 formed of plastic. Around this axis 41, two arc holes 44 and 45 are formed. As for these arc mouths 44 and 45, coin engagement strip 42 and 43 which are formed on the both end of rough-V-shaped cradle 40 are freely inserted, respectively.

One pair of bearing parts 14C are formed on the upper edge portion of door body 7 and a long pin axis 14B of metal is inserted. The rough-V-form member at the right of FIG. 8 is a yoke body 7A which is made of metal plate and, at the center of the trailing edge, an iron part 55 to make a magnetic circuit is stuck out and bent.

First, the plastic cancel lever 3 is inserted from the back edge 3K thereof into the vertical long hole 3A in the front body 1 which is shown in FIG. 3. Then, the bow parts 3C are inserted into the vertical long hole 3A against to the elasticity thereof and the cancel lever 3 is held without being extracted.

The thickness gage 1C and diameter gage 1E of metal are preinstalled on the metallic plate 1B ( referring to FIG. 3). That is, the screw 1H is inserted into the vertical long hole 1F of diameter gage 1E and also the oblong holes 1J of plate 1B, and is screwed in the screw holes 1D of thickness gage 1C.

At this time, the slide portion 1G of diameter gage 1E is slidably inserted in the slit of plate 1B. Next, the thickness gage 1C and diameter gage 1E are fixed on the plate 1B while inserting the desired coin into the openings 2A of plate 1B. Or, using the ruler which is made from the metal which has the thickness which is the same as the desired coin and has the width which is the same as the diameter of desired coin, the thickness gage 1C and diameter gage 1E are fixed on the plate 1B.

In other words by moving the diameter gage 1E, the opening coin diameter is set and, by moving the thickness gage 1C, the opening coin thickness is set.

Then, the screws 1H are fastened up and the thickness gage 1C and diameter gage 1E are fixed on the plate 1B. As the result, a coin with the diameter which is bigger than the desired coin or a coin with bigger thickness is not insertable into the passage 25 from the deposit opening 2. On the other hand, the slightly elongated shutter 8D which is shown in FIG. 6 is preinstalled at the chute cover body 8. That is, the shutter 8D is stretched and the one pair of semicircular axes 8J at the center thereof are inserted into the one pair of axis receiving bearings 8E from the reverse of chute cover body 8 (referring to FIG. 7).

After this, the shutter 8D is rotated about the semicircular axes 8J and is rises up to be pivoted without disconnecting. Next, the base body 6 of FIG. 4 and the chute cover body 8 of FIG. 6 are combined (to form an integral unit). That is to say, the projection 6H of base body 6 is fitted to the ring part 8H of the chute cover body 8 and the projection 8F of chute cover body 8 is fitted to the ring part 6F of base body 6. Moreover, the projection 16 of base body 6 is fitted to the ring parts 15A of chute cover body 8 and is combined (to form an integral unit).

After this, the hook portions 6A of base body 6 are inserted into the keyhole 1L of plate 1B. At the same time, into the cuttings 1N of plate 1B, the hook portions 6D and 8A of base body 6 and chute cover body 8 are inserted. Thus, the base body 6 and the chute cover body 8 which were made integrally are slid at the same time. As the result, the hook parts are fitted to the slender parts of keyholes and the base body 6 and the chute cover body 8 are fixed on the plate 1B (to form an integral unit).

The lid plate 4B is put into the rejection (return) mouth 4 of front body 1 and the pivot portions 4D are inserted in the recesses 4A, and the lid plate 4B is suspended, being free to sway. Next, the ring-shaped spring 3D (referring to FIG. 4) is fitted outside to the big diameter part of axis 91 of the base body 6. Then, the plate 1B is covered with the front body 1 and the back edge 3K of cancel lever 3 is inserted into the vertical long hole 3A. At this time, on the axis 91 of base body 6, the ring-formed bearing 92 of cancel lever 3 is put in opposition to the elasticity and then the front body 1 is fixed on the plate 1B (to form an integral unit).

The hold plate 3E (referring to FIG. 4) of the arch lever, which consists of iron metal is put into the bow parts 3C, as shown in FIG. 1. At the same time, the bearing 92 is put into the circle hole 3F and the back edge 3K of cancel lever 3 is fitted into the interval of hook part 3H and projection 3J. Next, one end 3G of the spring 3D is engaged to the hook part 3H of hold plate 3E and the other end 3L is engaged to the hook part 6J (referring to FIG. 1) near to the axis 91 of base plate 6. Next, the pipe part of rough L-shaped link 3M (referring to FIG. 4) is inserted into the pipe part 6P (referring to FIG. 5) at the rough center of upper edge part of base body 6. At the same time, the projection 3N at the other end thereof is rotatably inserted into the long hole 3P of cancel lever 3.

Then, the elliptical part 3Q at the pipe part tip of link 3M which is projected inside the base body 6, i.e., to the side of the passage 25 is inserted into the elliptical hole 3S of wiper 3R. The mounting bolt 3T is inserted into the pipe part of link 3M and it is fastened up by the nut 3U and therefore the wiper 3R is fixed. On the other hand, as shown on FIG. 8, the bolt 57C is slidably inserted into the long hole 57B for arranging the inclination rail 57. The bolt 57C is further inserted into the hole 57D at the lower edge of door body 7 and the nut 57E is fastened up and fixed.

Next, the little long screw 7B, for adjusting, is screwed and inserted into the screw hole which was opened at the bottom tip of yoke 7A. The mounting portion 7C, which becomes a wide U-form at the upper edge, is inserted between the axis receiving parts 14C of door 7. Then, the rough tubular spring 14A is inserted between the mounting portion 7C. Thus, as shown in FIG. 2, the long pin 14B is inserted into the axis receiving part 14C, the hole of mounting portion 7C, the spring 14A, the hole of mounting portion 7C, axis receiving part 14C in that order.

Next the hook part 14D at the center of spring 14A is engaged to the outside of door body 7 resisting the elasticity thereof. As shown in FIG. 2 one end 14E of the spring 14A is engaged on the yoke 7A resisting the elasticity thereof and the other end 14F thereof is contacted on the door body 7 resisting the elasticity. Therefore, the yoke 7A freely opens and closes the door plate 7 about the length pin 14B. Incidentally, the yoke 7A is generally closed and the yoke 7A is opened resisting the elasticity of spring 14A.

Also, the iron part 55 for the magnetic circuit extends freely into the big window hole 7D of door body 7. Next, as shown in FIG. 1 and FIG. 2, the door body 7 which is integrally combined with the yoke 7A is installed on the base body 6 resisting the elasticity of hook part 14D. That is, the pin axis 14B is inserted in the axis receiving portions 6K of the base body 6 and the hook part 14D is arranged to engage to the cutting 6E in opposition to the elasticity thereof After this, as shown near the center of FIG. 1, the small V-shaped braking lever 61 for the coin is installed on the axis 62. The braking lever 61 which is made of metal has a shape as shown near the center of FIG. 4. The tip 63 protrudes swinging freely within the rough semicircle window hole 6L which is opened at the base body 6. This tip 63 is the member to stop the movement of coin which comes from deposit opening 2 and to drop the coin at the cradle 40. Moreover, as shown at the center of FIG. 1, the slightly long pendulum lever 71 is installed on the axis 72. As for the pendulum lever 71 which is made of metal, as shown on the central left of FIG. 4, the weight 73 is attached to the bottom tip. Moreover, on this bottom tip, the separating portion 74 for the coin is formed to extend within the are hole 75, being free to sway. Further, symbol 76 designates a screw for adjusting, and it is inserted into the separating portion 74 by screwing. The screw 76 is in contact with the projection 75A (referring to FIG. 5) near the arc hole 75 and the position of the separating portion 74 is adjusted by the movement thereof.

As shown at the bottom of FIG. 1, the small rectangular detection switch 80 is arranged on the mounting portion 6C by bolts and nuts. The perspective view of the detection switch 80 is shown in the lower left of FIG. 4. In addition, the magnet 50 is put in the case 6G at the center of FIG. 1 and the hold plate 53 of FIG. 4 is put therein in opposition to the elasticity thereof and becomes the lid.

As shown at the center right of FIG. 2, the small V-shaped cradle 40 is installed on the axis 41. The cradle 40 which is made of metal is installed rotatably on the door plate 7 by means of the axis 41. As shown in the exploded view of FIG. 8, the engagement strip 42 extending into the arc hole 44 and the engagement strip 43 extending into the arc hole 45 are freely inserted and protrude within the passage 25 respectively. Next, as shown at the lower left of FIG. 2, the slender two levers 83A and 83B for string-proofs are swingably installed by means of the bearings 8C of chute cover body 8 and the pin axis 84.

As shown in FIG. 6, as for the whole rough-J-shaped levers 83A and 83B which are made from resin, the bottom tip parts 85A and 85B thereof are stored in the cover part 8L of shutter 8D which was preinstalled. Therefore, the bottom tip parts 85A and 85B are exposed to the cutting 6M through the accommodating chute 26 (referring to FIG. 1) from the cutting 8N of chute cover body 8 and then become free to sway.

These bottom tip parts 85A and 85B are generally snapped outside by the failing coin. However, when the coin which is hung by a string turns on the operation arm 82 of detection switch 80 and then the coin is drawn up, the said coin is prevented from being further the drawn-up. In other words, the upper edge in the periphery of the coin or the edge of the coin contacts any of the five lower edges containing the lower edges of the bottom tip parts 85A and 85B in amount which were formed by three notches in amount of the bottom tip parts 85A and 85B and the drawing of the said coin is prevented. Incidentally, in the embodiment of the illustration, three notches in amount are made to form five lower edges in amount to be able to correspond to such a hanging coin thread of a diameter of 20 mm to 25 mm.

Figure 12:
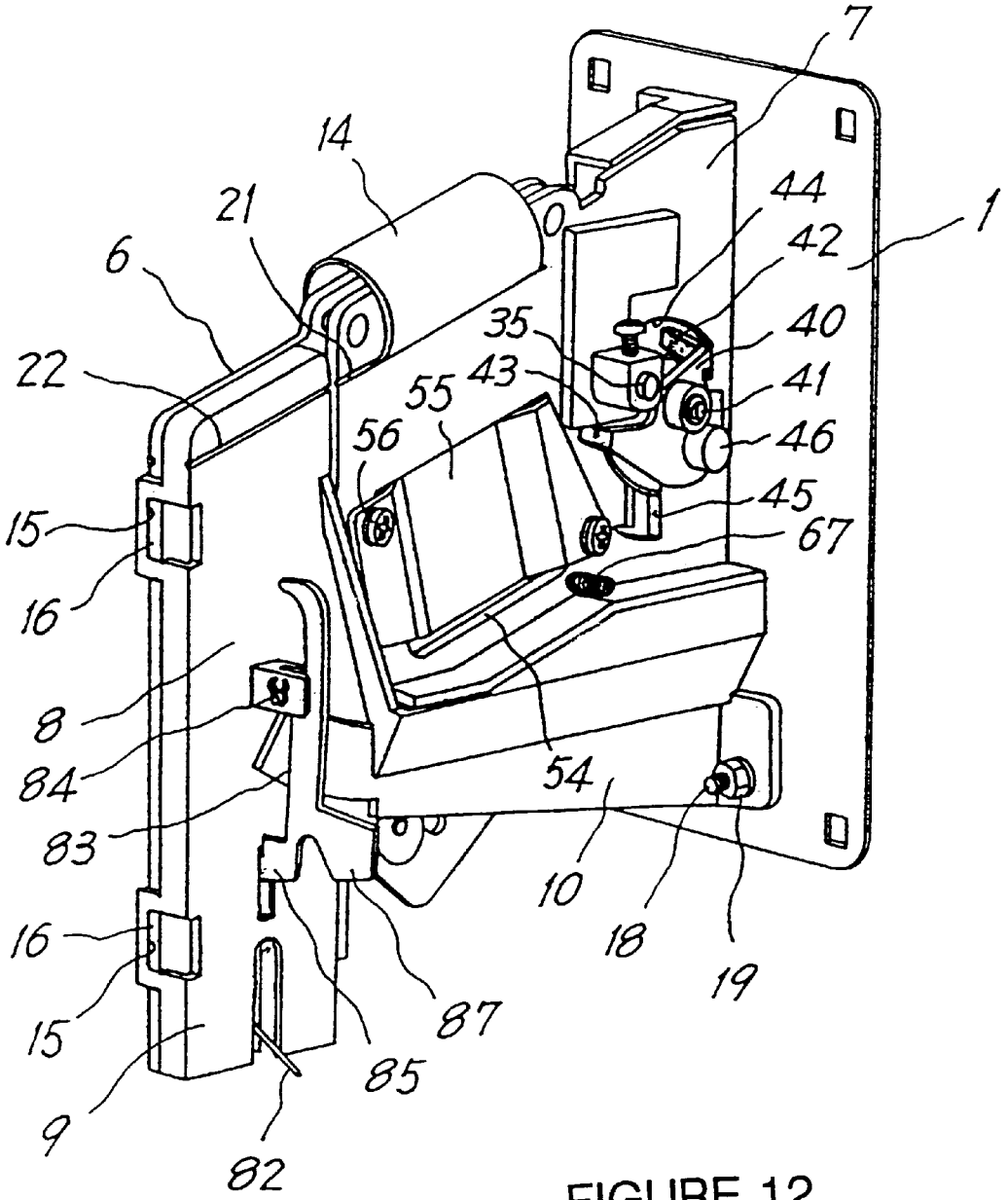
FIGURE 12 (PRIOR ART)
FIG. 12 is a perspective view from the back of the above prior art.
Figure 13:
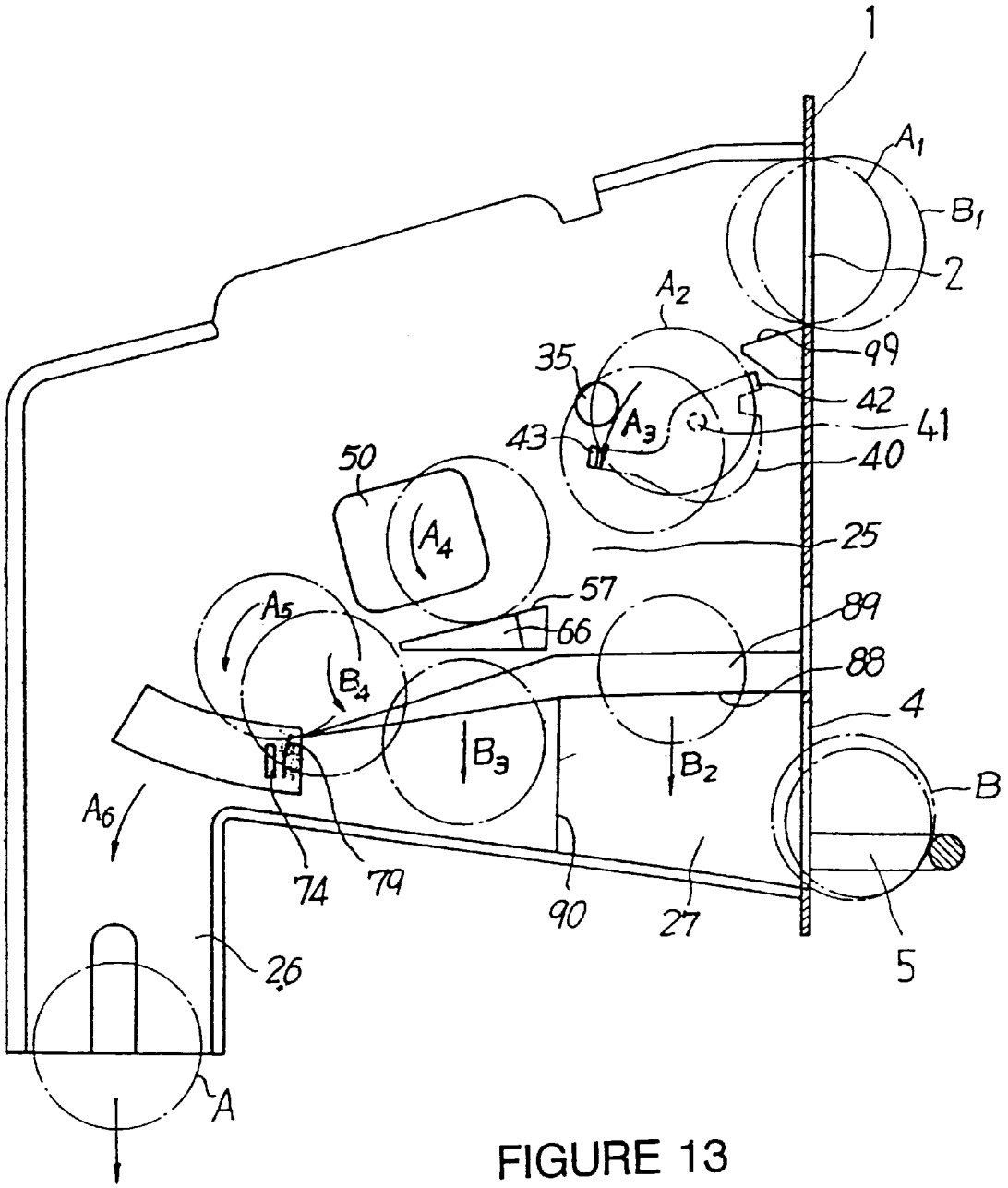
FIGURE 13 (PRIOR ART)
FIG. 13 is a diagram to explain the operation of the above prior art.

Therefore, the number and the position of the lower edges which are formed by a plurality of notches may be formed, considering the size of large or small coin. Also, the number and the position of the lower edges are of course permitted to change desirably, depending on the kind of coins. The projection 8Y in FIGS. 6 and 7 functions as a spacer between the base body 6 and cover body 8. Further, as for the arranged shutter 8D which is made from thermoplastic resin, the cover part 8L at the lower portion thereof which protects the operation arm 82 of detection switch 80 is heavily formed. Therefore, the bottom tip of cover part 8L goes through the cutting 8N, and is stopped at the wall of cutting 6M. Therefore, the stopper 8K which is formed at the upper part of shutter 8D is usually separated from the L-shaped narrow hole 8M which was formed on the inclined upper edge of chute cover body 8. The side wall portions 10 shown in FIGS. 6, 7 (see also FIG. 12) function as a chute plate for guiding a returned coin. The shutter 8D is a member to prevent the coin from continued movement. When the coin falls into the accommodating chute 26, the cover part 8L is snapped outside by the coins and the stopper 8K goes into the narrow hole 8M. As the result, the passage 25 is blocked off by the stopper 8K and an invasion by the following coin is prevented from happening.

Also, when pushing down the cancel lever 3 in opposition to the spring 3D, the lever 3 is rotated about the axis 91 as shown in FIG. 1. Thus, the link 3M is rotated about the axis line of bolt 3T. As the result, the cam part 93 (referring to FIG. 3) of cancel lever 3 pushes down the projection 95 (referring to the FIG. 9) of door body 7 so that the door body 7 is opened. At the same time, the wiper 3R of FIG. 4 passes the passage 25 near the magnet 50. Therefore, the coin which is stopped at the passage 25 and falls and is returned (rejected). Further, the member of small rectangular at the center of left side in FIG. 1 is an adjuster 3V. It is the one to adjust relation between the stroke of cancel lever 3 and the open and close degree of door body 7. The perspective view of the adjuster 3V is shown at the upper left of FIG. 4. The adjuster 3V is fixed to the hold plate 3E by means of the long hole and the screw 3W. Therefore, it is possible for the adjuster 3V to slide to the upper or lower direction. Still, the projection 3X of adjuster 3V is inserted into the vertical long hole 3Y of hold plate 3E and becomes slidably. Because this projection 3X is contacted to the projection 95 (referring to the FIG. 9), it gets for the adjustment of the stroke of cancel lever 3 to be possible.

In FIG. 1, the formed streak members at the edge and in the center of base body 6 are reinforcement ribs 6Z which were preferably molded. In the same way, at FIG. 2, the formed streak members at the edge and in the center of base body 7 are reinforcement ribs 7Z which are preferably molded. In FIG. 4, the projection 6Y at the upper right thereof is molded on the base body 6 and is used for the positioning at the time of the assembly. The small star-shaped member which is shown at the lower direction of this projection 6Y is the washer Z, and the washer is fixed on the surface of base body 6 to catch the tip of screw 7B for the adjustment of yoke 7A. In FIG. 6, the projection 8Y at the upper right thereof is molded on the chute cover body 8 and is used for the positioning at the time of the assembly.

Two nails 7X and 7Y which are formed on the right edge of yoke 7A in the FIG. 8 are freely inserted in the circle holes 7U and 7V which were opened in the door body 7 respectively. Even if the door body 7 is opened by the pushing-down of cancel lever 3, the yoke body 7A is not moved.

Because the nails 7X and 7Y project into the circle holes 7U and 7V respectively, the coin with which the passage 25 is filled falls in.

The Projection which is at the center of the lower edge of door body 7 in FIG. 9 is a stopper 7W which is molded on the door body 7. This stopper 7W is a member for determining the gap between the base body 6 and door body 7, i.e. the width of coin passage 25.

As above mentioned, according to the present invention, main parts are plastic formed products so that the parts themselves are very light and the weight of the whole apparatus after assembly is remarkably lightweight. Therefore, the effect in case of practical use is great in cases of the parts conveyance, the construction of apparatus, the carriage of apparatus product and so on. In addition, there is a big advantage as to the lightening of the vending machine, the game machine and so on, to which the coin selecting apparatus of the invention is incorporated.

Also, since the apparatus of the invention uses a metallic plate between the front part and the other parts, the whole strength increases and also there is a strong advantage against impact. Also, since this invention uses a metallic plate, the electrostatic countermeasure feature is made easy. Moreover, there is an advantage that coin passage conditions can be confirmed by the transparent portions used according to the invention. In addition, as for this invention, there is an advantage which the size of deposit opening can be changed into every size of the coin in various ways. Also, since it is not necessary to adjust the string-proof levers corresponding to the coin size, there is a big effect that the change of the coin can be very simply corresponded thereto.

While specific embodiments of the invention have been shown and described in detail to illustrate the application of the principles of the invention, it will be understood that the invention may be embodied otherwise without departing from such principles.

What is claimed is:

1. A coin selecting apparatus comprising:

a plate which has a vertical length opening for depositing a coin there into, said plate having a pair of upper and lower oblong holes near said opening and also having a vertical length slit near said oblong holes;

a diameter gage slidably disposed on said plate and having a guide portion to partially close a length in said opening, said diameter gage being a rectangular plate having a pair of upper and lower vertical long holes and a slide portion to be slidably inserted in said slit and also having a coin guide portion which closes said opening; and a thickness gage slidably disposed on said plate to partially close a width in said opening, said thickness gage being a rectangular plate which has screw holes to fasten screws extending through said vertical long hole and oblong hole slidably and for partially closing a width in said opening.

2. The coin selecting apparatus according to claim 1, wherein:

said plate is part of a front part, said plate consisting of a plastic formed product having a rectangular plate form, said front part further including a base part which consists of a plastic formed product having an approximately rectangular plate form, a chute cover part which consists of a plastic formed product having an approximately tail-fin-shaped form; and a door part which consists of a plastic formed product having a slightly small rectangular plate form.

3. The coin selecting apparatus according to claim 1, wherein:

said plate is part of a front part, said plate consisting of a plastic formed product having a rectangular plate form, said front part further including a base part which consists of a plastic formed product having an approximately rectangular plate form, a chute cover part which consists of a plastic formed product having an approximately tail-fin-shaped form; and a door part which consists of a plastic formed product having a slightly small rectangular plate form.

4. The coin selecting apparatus according to claim 2, wherein: a metallic plate is provided on a reverse side of said front part.

5. The coin selecting apparatus according to claim 2, wherein: said door part is transparent.

6. A coin selecting apparatus comprising:

a plate which has a vertical length opening for depositing a coin and has a pair of upper and lower oblong holes near said opening;

a diameter gage being a rectangular plate which has a pair of upper and lower vertical long holes and has a guide portion to partially seal a length in said opening; and a thickness gage in the form of a rectangular plate which has screw holes to fasten screws extending through said vertical long and oblong holes slidably and for sealing the width in said opening partially.

7. A coin selecting apparatus according to claim 6, wherein said plate has a vertical length slit near said oblong holes; and said diameter gage has a slide portion to be slidably inserted in said slit.

8. The coin selecting apparatus according to claim 6, wherein:

said plate is part of a front part, said plate consisting of a plastic formed product having a rectangular plate form, said front part further including a base part which consists of a plastic formed product having an approximately rectangular plate form, a chute cover part which consists of a plastic formed product having an approximately tail-fin-shaped form; and a door part which consists of a plastic formed product having a slightly small rectangular plate form.

9. The coin selecting apparatus according to claim 7, wherein:

said plate is part of a front part, said plate consisting of a plastic formed product having a rectangular plate form, said front part further including a base part which consists of a plastic formed product having an approximately rectangular plate form, a chute cover part which consists of a plastic formed product having an approximately tail-fin-shaped form; and a door part which consists of a plastic formed product having a slightly small rectangular plate form.

10. The coin selecting apparatus according to claim 8, wherein: a metallic plate is provided on a reverse side of said front part.

11. The coin selecting apparatus according to claim 8, wherein: said door part is transparent.

12. The coin selecting apparatus according to claim 6, further comprising:

a diameter gage slidably disposed on said plate and having a guide portion to partially close a length in said opening; and a thickness gage slidably disposed on said plate to partially close a width in said opening, wherein said plate has a vertical length opening for depositing a coin thereinto.

13. A coin selecting apparatus according to claim 12, wherein said plate has a vertical length slit near said oblong holes; and said diameter gage has a slide portion to be slidably inserted in said slit.

14. The coin selecting apparatus according to claim 13, wherein said metallic plate has a pair of upper and lower oblong holes near said openings, said diameter gage is a rectangular plate which has a pair of upper and lower vertical long holes, and said thickness gage is a rectangular plate which has screw holes for fastening the screws being pierced through said vertical long and oblong holes slidably.

15. The coin selecting apparatus, comprising:

a front part with a plate formed as a plastic formed product having a rectangular plate form;

a metallic plate provided on a rear side of said front part plate and connected to said front plate, said metallic plate having a coin deposit opening;

a base part which is formed as a plastic formed product having an approximately rectangular plate form, said base part being connected to said metallic plate;

a chute cover part which is formed as a plastic formed product having an approximately tail-fin-shaped form, said cover part being connected to said metallic plate; and a door part which consists of a plastic formed product having a slightly small rectangular plate form, said door part being connected to said base part.

16. The coin selecting apparatus according to claim 15, wherein: said door part is transparent.

17. The coin selecting apparatus according to claim 15, wherein said metallic plate coin deposit opening has a vertical length slit near said oblong holes, and said diameter gage has a slide fragment to be slidably inserted in said slit.

* * * * *